US011738844B1

(12) United States Patent
Baker

(10) Patent No.: US 11,738,844 B1
(45) Date of Patent: Aug. 29, 2023

(54) TROLLING MOTOR FOR AN OVERBOARD PERSON

(71) Applicant: Wayne Baker, Trenton, NJ (US)

(72) Inventor: Wayne Baker, Trenton, NJ (US)

( * ) Notice: Subject to any disclaimer, the term of this patent is extended or adjusted under 35 U.S.C. 154(b) by 220 days.

(21) Appl. No.: 17/341,654

(22) Filed: Jun. 8, 2021

(51) Int. Cl.

| | |
|---|---|
| ***B63H 21/21*** | (2006.01) |
| ***B63H 20/00*** | (2006.01) |
| ***B63H 21/17*** | (2006.01) |
| ***B63H 20/20*** | (2006.01) |
| ***B63H 20/12*** | (2006.01) |

(52) U.S. Cl.
CPC ..... *B63H 21/21* (2013.01); *B63H 20/007* (2013.01); *B63H 20/12* (2013.01); *B63H 20/20* (2013.01); *B63H 21/17* (2013.01); *B63B 2213/02* (2013.01); *B63H 2021/216* (2013.01)

(58) Field of Classification Search
CPC ..... B63H 21/21; B63H 21/17; B63H 20/007; B63H 20/12; B63H 20/20; B63H 2021/216; B63B 2213/02
See application file for complete search history.

(56) References Cited

U.S. PATENT DOCUMENTS

| | | | | |
|---|---|---|---|---|
| D308,525 | S | 6/1990 | Robbins | |
| 5,445,545 | A * | 8/1995 | Draper | B63H 20/007 440/66 |
| 6,054,831 | A * | 4/2000 | Moore | G08C 17/02 318/16 |
| 8,645,012 | B2 | 2/2014 | Salmon | |
| 8,879,359 | B2 | 11/2014 | DePasqua | |
| 9,676,462 | B2 | 6/2017 | Bemnloehr | |
| 9,758,222 | B2 | 9/2017 | Grace | |
| 9,969,474 | B1 | 5/2018 | Truax | |
| 2009/0121931 | A1 * | 5/2009 | Katz | G01S 5/0231 342/385 |
| 2018/0129213 | A1 | 5/2018 | Pelin | |
| 2020/0255104 | A1 * | 8/2020 | Gonring | B63B 45/02 |

FOREIGN PATENT DOCUMENTS

| | | |
|---|---|---|
| CA | 2895863 | 10/2017 |

* cited by examiner

*Primary Examiner* — Stephen P Avila
(74) *Attorney, Agent, or Firm* — Kyle A. Fletcher, Esq.

(57) ABSTRACT

The trolling motor for an overboard person comprises a trolling motor and a wrist worn device. The trolling motor may be a battery-operated propulsion device that is operable to propel and steer a water craft. The wrist worn device may be worn by a person on the water craft. A control unit within the trolling motor may communicate wirelessly with the wrist worn device and may be cognizant of a relative position of the wrist worn device with respect to the water craft. If the person falls overboard, a separation distance between the wrist worn device and the control unit may increase. Upon a determination that the separation distance has exceeded a predetermined distance threshold, the control unit may direct the trolling motor to energize, deenergize, or reverse direction such that the trolling motor may move the water craft closer to the person.

20 Claims, 5 Drawing Sheets

TROLLING MOTOR FOR AN OVERBOARD PERSON

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of trolling motors and rescue devices, more specifically, a trolling motor for an overboard person.

SUMMARY OF INVENTION

The trolling motor for an overboard person comprises a trolling motor and a wrist worn device. The trolling motor may be a battery-operated propulsion device that is operable to propel and steer a water craft to which the trolling motor is removably coupled. The wrist worn device may be adapted to be worn by a person on the water craft. A control unit within the trolling motor may communicate wirelessly with the wrist worn device and may be cognizant of a relative position of the wrist worn device with respect to the water craft. If the person falls overboard, a separation distance between the wrist worn device and the control unit may increase. Upon a determination that the separation distance between the wrist worn device and the control unit has exceeded a predetermined distance threshold, the control unit may direct the trolling motor to energize, deenergize, or reverse direction such that the trolling motor may move the water craft closer to the person.

An object of the invention is to provide a trolling motor for moving a water craft and a wrist worn device adapted to be worn by a person on the water craft and in wireless communication with a control unit of the trolling motor.

Another object of the invention is to determine the position of the control unit and the position of the wrist worn device, to communicate the position of the wrist worn device to the control unit, and to calculate a separation distance between the two positions.

A further object of the invention is to determine that a person on the water craft wearing the wrist worn device has fallen overboard base in whole or in part on the calculated separation distance exceeding a predetermined threshold.

Yet another object of the invention is to energize, deenergize, and/or reverse an electric motor in the trolling motor in an effort to bring the water craft closer to the overboard person.

These together with additional objects, features and advantages of the trolling motor for an overboard person will be readily apparent to those of ordinary skill in the art upon reading the following detailed description of the presently preferred, but nonetheless illustrative, embodiments when taken in conjunction with the accompanying drawings.

In this respect, before explaining the current embodiments of the trolling motor for an overboard person in detail, it is to be understood that the trolling motor for an overboard person is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the trolling motor for an overboard person.

It is therefore important that the claims be regarded as including such equivalent construction insofar as they do not depart from the spirit and scope of the trolling motor for an overboard person. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
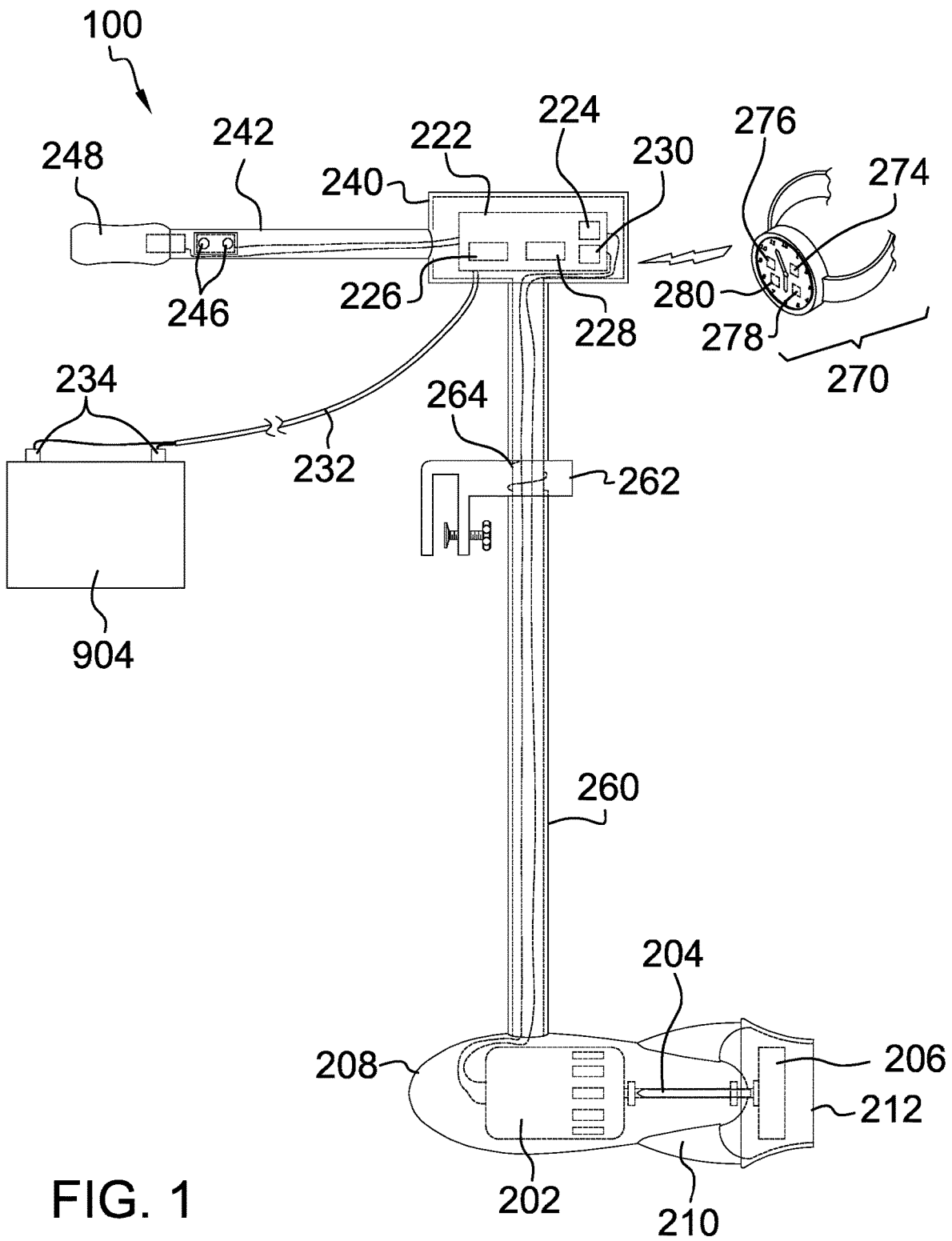
FIG. 1 is a side view of the device of the disclosure.
Figure 2:
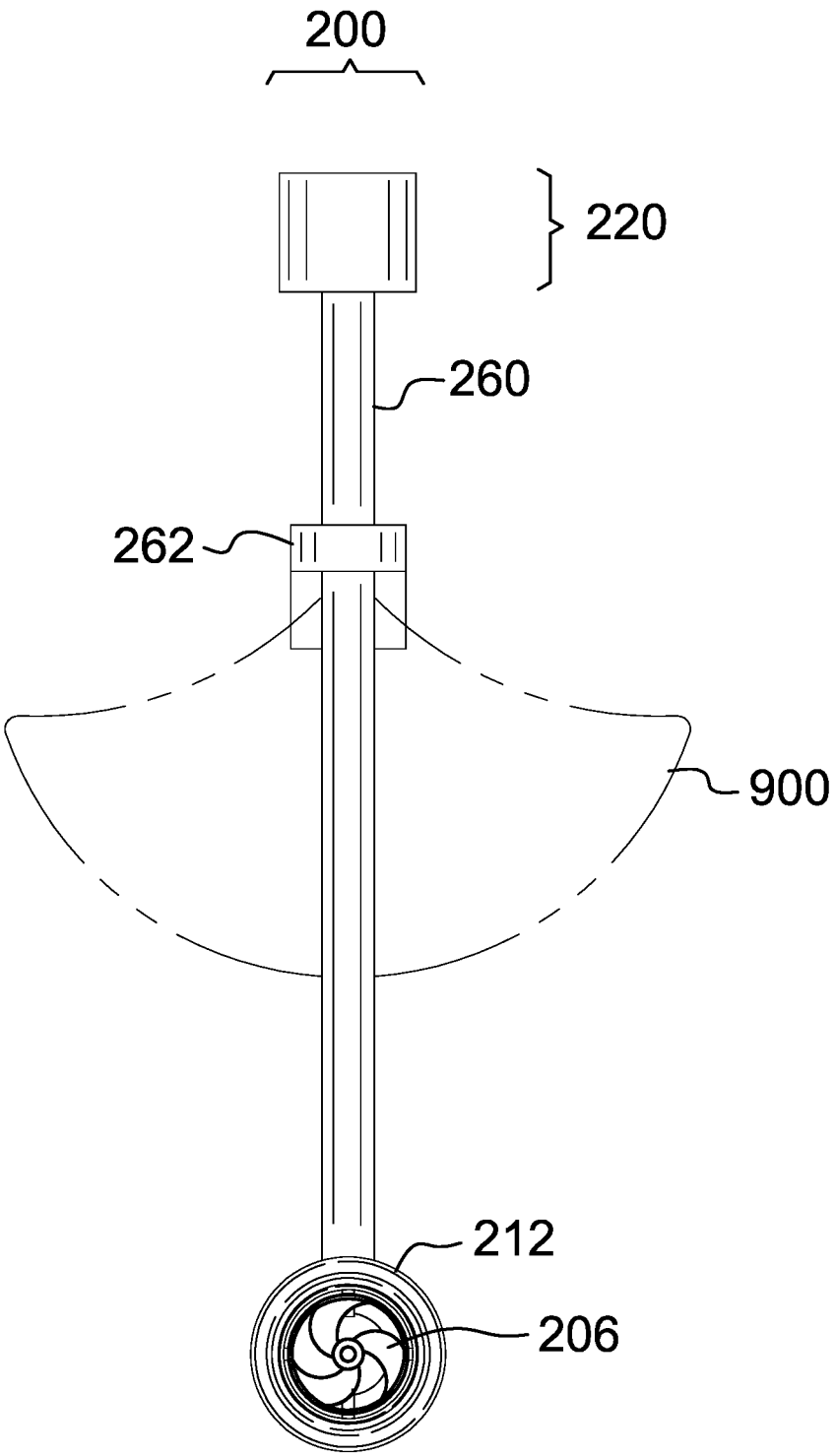
FIG. 2 is a rear view of the device of the disclosure.
Figure 3:
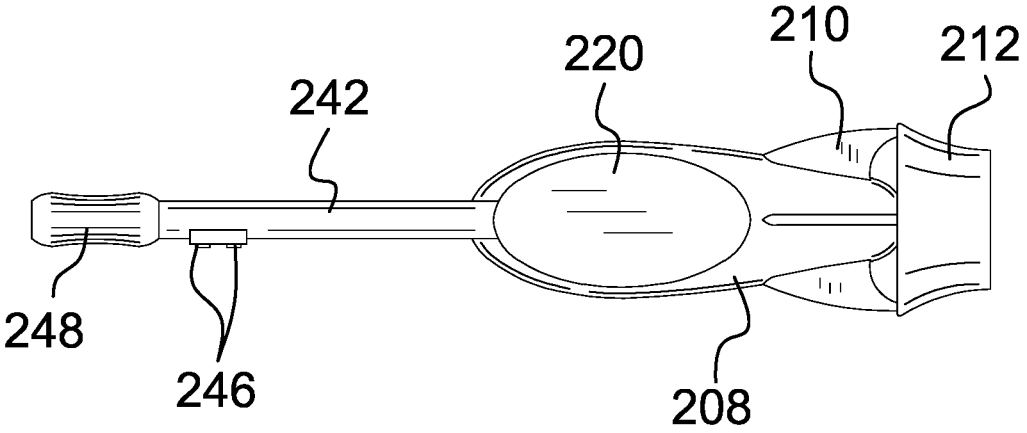
FIG. 3 is a top view of the device of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 5.

The trolling motor for an overboard person 100 (hereinafter invention) comprises a trolling motor 200 and a wrist worn device 270. The trolling motor 200 may be a battery-operated propulsion device that is operable to propel and steer a water craft 900 to which the trolling motor 200 is removably coupled. The wrist worn device 270 may be adapted to be worn by a person on the water craft 900. A control unit 220 within the trolling motor 200 may communicate wirelessly with the wrist worn device 270 and may be cognizant of a relative position of the wrist worn device 270 with respect to the water craft 900. If the person falls overboard, a separation distance between the wrist worn device 270 and the control unit 220 may increase. Upon a determination that the separation distance between the wrist worn device 270 and the control unit 220 has exceeded a predetermined distance threshold, the control unit 220 may direct the trolling motor 200 to energize, deenergize, or reverse direction such that the trolling motor 200 may move the water craft 900 closer to the person.

The trolling motor 200 may comprise an electric motor 202, the control unit 220, and a steering shaft 260. The control unit 220 may be coupled to the top end of the steering shaft 260 and the electric motor 202 may be coupled to the bottom end of the steering shaft 260. The steering shaft 260 may removably couple to the water craft 900 via a gunwale clamp 262 such that the electric motor 202 may be located below the surface of the water. The electric motor 202 may turn an impeller 206 when energized such that the impeller 206 may move the water craft 900. The electric motor 202 may be adapted to be energized and deenergized under control of the person via one or more operator controls 246 located on the control unit 220. The trolling motor 200 may be adapted to steer the water craft 900 by pivoting at the gunwale clamp 262 when the person moves a tiller 242 coupled to the control unit 220.

The electric motor 202 may convert electrical energy into mechanical energy. The electric motor 202 may cause rotation of a motor shaft 204 when electrical energy is applied to the electric motor 202. The electrical energy applied to the electric motor 202 may be controlled by a motor control circuit 230 in the control unit 220. The impeller 206 may rotate in a first rotational direction when the electric motor 202 is energized using a first electrical polarity, moving the water craft 900 forward. The impeller 206 may rotate in a second rotational direction when the electric motor 202 is energized using a second electrical polarity, moving the water craft 900 in reverse. The impeller 206 may cease rotating when the electric motor 202 is deenergized.

The electric motor 202 may be enclosed within a motor housing 208 which may prevent water from reaching the electric motor 202. The motor housing 208 may comprise an impeller cover 212 that may prevent the person from accidently touching the impeller 206. The impeller cover 212 may be coupled to the motor housing 208 via a plurality of fins 210 which may allow the water to reach the impeller 206 from the front and may allow the water to exit the impeller 206 from the rear when the electric motor 202 is rotating in the first rotational direction.

The control unit 220 may comprise a controller 222. The controller 222 may comprise a first microcontroller 224, a first GPS 226, a first wireless transceiver 228, and the motor control circuit 230. The first microcontroller 224 may be a computer processor that incorporates the functions of a central processing unit in the form of one or more integrated circuits. The first microcontroller 224 may be a multipurpose, clock driven, register based, digital-integrated circuit. The first microcontroller 224 may accept binary data as input, may process the binary data according to instructions stored in memory contained within the first microcontroller 224, and may provide results as output. The first microcontroller 224 may contain both combinational logic and sequential digital logic. The first microcontroller 224 may operate on numbers and symbols represented in the binary numeral system. The first microcontroller 224 may monitor the one or more operator controls 246 and may determine when to energize, deenergize, and reverse the polarity of the electric motor 202 such that the trolling motor 200 responds appropriately when under control of the person.

The first microcontroller 224 may electrically communicate with the first GPS 226 to determine a position of the control unit 220. The first microcontroller 224 may electrically communicate with the first wireless transceiver 228 in order to wirelessly communicate with the wrist worn device 270. The first microcontroller 224 may determine a position of the wrist worn device 270 from the messages. The first microcontroller 224 may calculate the separation distance from the position of the control unit 220 and the position of the wrist worn device 270.

The first microcontroller 224 may electrically communicate with the motor control circuit 230 in order to energize the electric motor 202, deenergize the electric motor 202, and reverse the polarity of the electric motor 202. The first microcontroller 224 may be able to control a rotational speed of the electric motor 202 by directing the motor control circuit 230 to adjust the voltage and/or current reaching the electric motor 202. The control unit 220 may be powered from a battery 904. The control unit 220 may comprise a battery cable 232 to couple the control unit 220 to the battery 904 via a battery clamps 234. The controller 222 may be protected within a controller housing 240. The tiller 242 may comprise the one or more operator controls 246 and a speed control 248.

The one or more operator controls 246 may be adapted for the person to operate the electric motor 202. As non-limiting examples, the one or more operator controls 246 may be adapted to allow the person to energize the electric motor 202, deenergize the electric motor 202, reverse the direction of the electric motor 202, or combinations thereof. The one or more operator controls 246 may be accessible on the controller housing 240 or on the tiller 242.

The speed control 248 may be adapted to allow the person to change the rotational speed of the electric motor 202. The speed control 248 may be an input to the first microcontroller 224. In some embodiments, the speed control 248 may be located at the distal end of the tiller 242 such that the person may control the speed of the water craft 900 while steering.

The wrist worn device 270 may comprise a second microcontroller 274, a second GPS 276, and a second wireless transceiver 278. The wrist worn device 270 may be adapted to be worn by the person such that the position of the person may be determined by determining the position of the wrist worn device 270 using the second GPS 276.

In some embodiments, the wrist worn device 270 may comprise at least one biometric sensor 280. The at least one biometric sensor 280 may monitor one or more biometric parameters of the person which may be communicated wirelessly to the controller 222. The controller 222 may be adapted to utilize the one or more biometric parameters to supplement the decision that the person may have fallen overboard. As a non-limiting example, the at least one biometric sensor 280 may be a pulse sensor. A rapid increase in heart rate may be a further indication that the person has fallen overboard.

The second microcontroller 274 may be a computer processor that incorporates the functions of a central processing unit in the form of one or more integrated circuits. The second microcontroller 274 may be a multipurpose, clock driven, register based, digital-integrated circuit. The second microcontroller 274 may accept binary data as input, may process the binary data according to instructions stored in memory contained within the second microcontroller 274, and may provide results as output. The second microcontroller 274 may contain both combinational logic and sequential digital logic. The second microcontroller 274 may operate on numbers and symbols represented in the binary numeral system.

The second microcontroller 274 may electrically communicate with the first GPS 226 to determine a position of the wrist worn device 270. The second microcontroller 274 may electrically communicate with the second wireless transceiver 278 in order to wirelessly pass messages to and from the control unit 220. The messages may comprise the position of the wrist worn device 270 being communicated to the control unit 220.

In a non-emergency operating mode, the trolling motor 200 may be adapted to be under control of the person. Specifically, the speed and forward/reverse direction that the trolling motor 200 moves the water craft 900 may be determined by the one or more operator controls 246 and the speed control 248 and the water craft 900 may be steered using the tiller 242.

The control unit 220 may operate in an emergency operating mode when the control unit 220 determines that the person has likely fallen overboard. In the emergency operating mode, the speed and forward/reverse direction that the trolling motor 200 moves the water craft 900 may be determined by the control unit 220. The control unit 220 may repeatedly energize and deenergize the electric motor 202 in an effort to move the water craft 900 closer to the person wearing the wrist worn device 270 as determined by the separation distance calculated by the control unit 220 using position information acquired from the first GPS 226 in the control unit 220 and the second GPS 276 in the wrist worn device 270.

In some embodiments, the control unit 220 may move the water craft 900 forward and backward to reduce the separation distance without an active attempt to steer the water craft 900. In some embodiments, a bias spring 264 may force the trolling motor 200 to one side or the other in the absence to an external steering force. With the steering biased by the bias spring 264, the water craft 900 may circle a specific area.

In some embodiments, the wireless communication between the first wireless transceiver 228 and the second wireless transceiver 278 may be operable over Bluetooth® protocols.

In use, the trolling motor 200 may be coupled to the water craft 900 using the gunwale clamp 262 and the battery cable 232 may be electrically coupled to the battery 904 via the battery clamps 234. The person may don the wrist worn device 270. The person may maneuver the water craft 900 initially using the one or more operator controls 246, the speed control 248, and the tiller 242. The first microcontroller 224 in the control unit 220 may determine the position of the control unit 220 from the first GPS 226. The second microcontroller 274 in the wrist worn device 270 may determine the position of the wrist worn device 270 from the second GPS 276. The first microcontroller 224 may acquire position information from the wrist worn device 270 via communication between the first wireless transceiver 228 and the second wireless transceiver 278. The first microcontroller 224 may calculate the separation distance between the water craft 900 and the wrist worn device 270 from the position information. While the separation distance is less than the predetermined distance threshold, the control unit 220 may operate in the non-emergency operating mode. If and when the separation distance exceeds the predetermined distance threshold, the control unit 220 may operate in the emergency operating mode. In the emergency operating mode, the control unit 220 may ignore inputs from the one or more operator controls 246 and the speed control 248 and may direct the operation of the trolling motor 200 with the goal of reducing the separation distance. The control unit 220 may deenergize the electric motor 202, energize the electric motor 202 using the first electrical polarity, or energize the electric motor 202 using the second electrical polarity. The control unit 220 may recalculate the separation distance repeatedly to monitor the separation distance and may repeat the energization and de-energization of the electric motor 202 as required to move the water craft 900 closer to the person.

Figure 4:
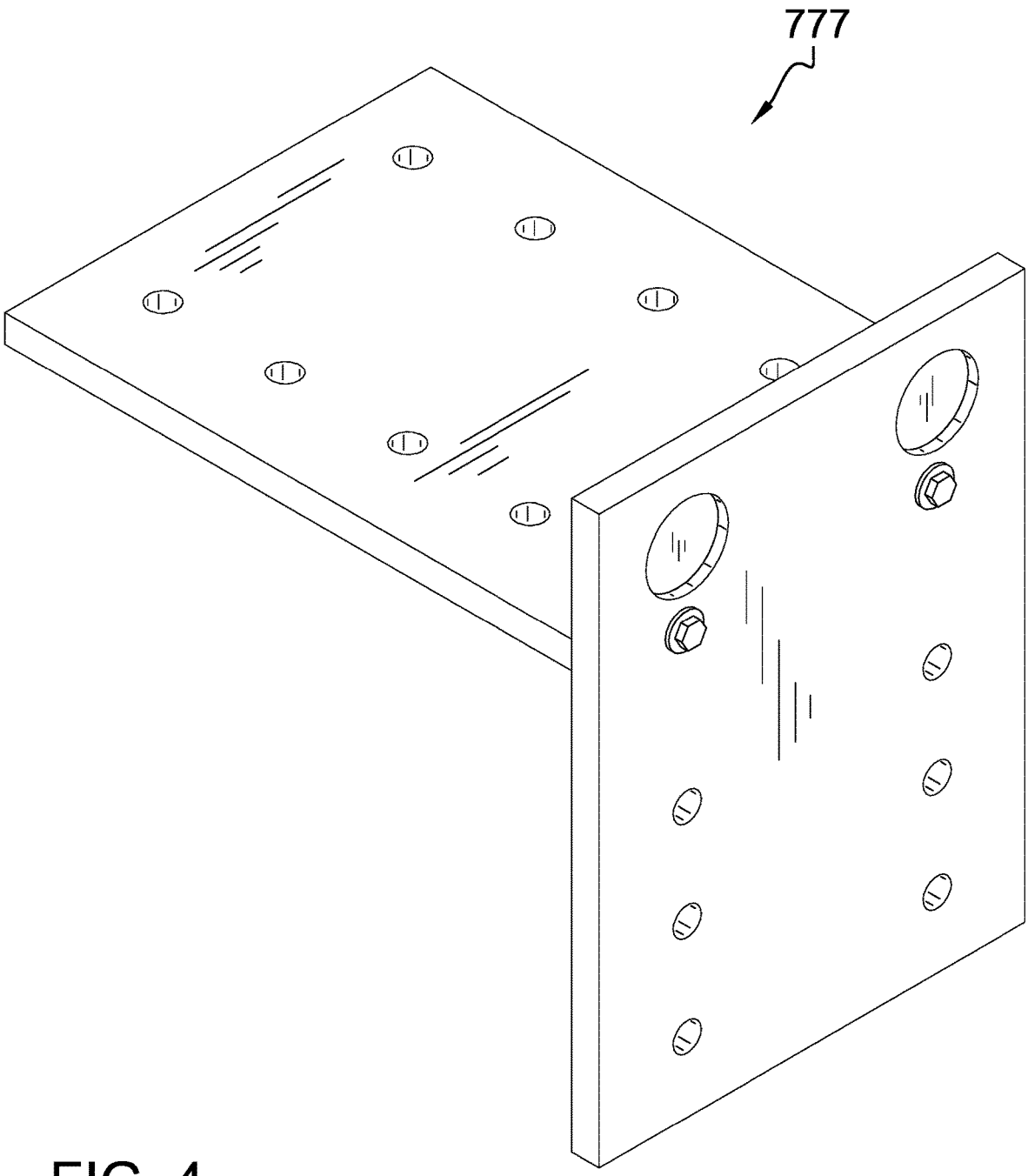
FIG. 4 is a perspective view of an optional mounting bracket for use with a boat.
Figure 5:
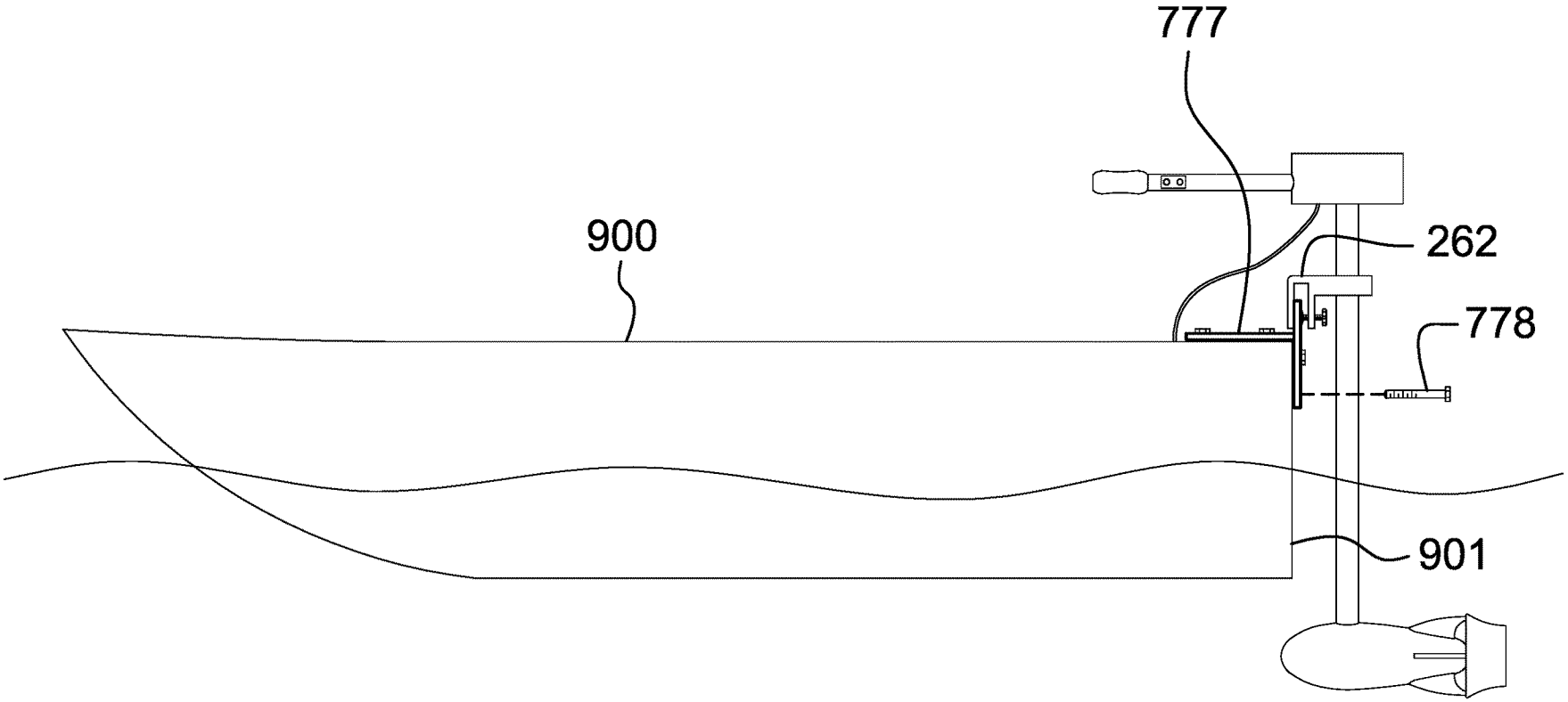
FIG. 5 is a perspective view of the device affixed to the mounting bracket, which in turn is affixed to a boat.

Referring to FIGS. 4-5, the invention 100 may include a mounting bracket 777. The mounting bracket 777 affixes to a rear surface 901 of the water craft 900. The mounting bracket 777 likely uses a fastener 778 to secure the mounting bracket 777 to the rear surface 901 of the water craft 900. The fastener 778 is probably a bolt, screw, rivet, nail, etc. The invention 100 affixes to the mounting bracket 777 via the gunwale clamp 262.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, "Bluetooth" may be a standardized communication protocol that is used to wirelessly interconnect electronic devices. Bluetooth® is a registered trademark of Bluetooth SIG.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", may refer to connecting, either directly or indirectly, and does not necessarily imply a mechanical connection.

As used herein, the words "data" and "information" may be used interchangeably to refer to raw, unprocessed facts and to facts that have been processed, structured, organized, or presented in a context that makes the facts useful.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, an "electric motor" may be a device that converts electric energy into rotational mechanical energy.

As used herein, "energize" and/or "energization" may refer to the application of an electrical potential to a system or subsystem.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "GPS" may refer to a device that uses signals received from a system of navigational satellites to determine the position of the device. GPS is an acronym for Global Positioning System.

As used in this disclosure, a "microcontroller" may be a small computer, often on a single integrated circuit, containing a processor core, memory, and programmable input/output peripherals.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used in this disclosure, a "sensor" may be a device that quantitatively measures a physical stimulus.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, a "transceiver" may be a device that is used to transmit and/or receive signals. The signals may be audible, optical, or RF in nature.

As used in this disclosure, "wireless" may be an adjective that is used to describe a communication channel that does not require the use of physical cabling.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A trolling motor for an overboard person comprising:

a trolling motor and a wrist worn device;

wherein the trolling motor is a battery-operated propulsion device that is operable to propel and steer a water craft to which the trolling motor is removably coupled;

wherein the wrist worn device is adapted to be worn by a person on the water craft;

wherein a control unit within the trolling motor communicates wirelessly with the wrist worn device and is cognizant of a relative position of the wrist worn device with respect to the water craft;

wherein upon a determination that a separation distance between the wrist worn device and the control unit has exceeded a predetermined distance threshold, the control unit directs the trolling motor to energize, deenergize, or reverse direction such that the trolling motor moves the water craft closer to the person;

wherein the trolling motor comprises an electric motor, the control unit, and a steering shaft;

wherein the electric motor is enclosed within a motor housing which prevents water from reaching the electric motor;

wherein the motor housing comprises an impeller cover which is adapted to prevent the person from accidently touching the impeller;

wherein the control unit comprises a controller;

wherein the controller comprises a first microcontroller, a first GPS, a first wireless transceiver, and the motor control circuit;

wherein the first microcontroller is a computer processor that incorporates the functions of a central processing unit in the form of one or more integrated circuits.

2. The trolling motor for an overboard person according to claim 1 wherein the control unit is coupled to the top end of the steering shaft and the electric motor is coupled to the bottom end of the steering shaft;

wherein the steering shaft removably couples to the water craft via a gunwale clamp such that the electric motor is located below the surface of the water;

wherein the electric motor turns an impeller when energized such that the impeller moves the water craft;

wherein the electric motor is adapted to be energized and deenergized under control of the person via one or more operator controls located on the control unit;

wherein the trolling motor is adapted to steer the water craft by pivoting at the gunwale clamp when the person moves a tiller coupled to the control unit.

3. The trolling motor for an overboard person according to claim 2 wherein the electric motor converts electrical energy into mechanical energy;

wherein the electric motor causes rotation of a motor shaft when electrical energy is applied to the electric motor;

wherein the electrical energy applied to the electric motor is controlled by a motor control circuit in the control unit;

wherein the impeller rotates in a first rotational direction when the electric motor is energized using a first electrical polarity, moving the water craft forward;

wherein the impeller rotates in a second rotational direction when the electric motor is energized using a second electrical polarity, moving the water craft in reverse;

wherein the impeller ceases rotating when the electric motor is deenergized.

4. The trolling motor for an overboard person according to claim 3 wherein the impeller cover is coupled to the motor housing via a plurality of fins which allow the water to reach the impeller from the front and allow the water to exit the impeller from the rear when the electric motor is rotating in the first rotational direction.

5. The trolling motor for an overboard person according to claim 4 wherein the first microcontroller is a multipurpose, clock driven, register based, digital-integrated circuit;

wherein the first microcontroller accepts binary data as input, processes the binary data according to instructions stored in memory contained within the first microcontroller, and provides results as output;

wherein the first microcontroller contains both combinational logic and sequential digital logic;

wherein the first microcontroller operates on numbers and symbols represented in the binary numeral system;

wherein the first microcontroller monitors the one or more operator controls and determines when to energize, deenergize, and reverse the polarity of the electric motor.

6. The trolling motor for an overboard person according to claim 5 wherein the first microcontroller electrically communicates with the first GPS to determine a position of the control unit;

wherein the first microcontroller electrically communicates with the first wireless transceiver in order to wirelessly communicate with the wrist worn device;

wherein the first microcontroller determines a position of the wrist worn device from the messages;

wherein the first microcontroller calculates the separation distance from the position of the control unit and the position of the wrist worn device.

7. The trolling motor for an overboard person according to claim 6 wherein the first microcontroller electrically communicates with the motor control circuit in order to energize the electric motor, deenergize the electric motor, and reverse the polarity of the electric motor;

wherein the first microcontroller is able to control a rotational speed of the electric motor by directing the motor control circuit to adjust the voltage and/or current reaching the electric motor;

wherein the tiller comprises the one or more operator controls and a speed control.

8. The trolling motor for an overboard person according to claim 7 wherein the one or more operator controls are adapted for the person to operate the electric motor.

9. The trolling motor for an overboard person according to claim 8 wherein the speed control is adapted to allow the person to change the rotational speed of the electric motor;

wherein the speed control is an input to the first microcontroller.

10. The trolling motor for an overboard person according to claim 9 wherein the wrist worn device comprises a second microcontroller, a second GPS, and a second wireless transceiver;

wherein the wrist worn device is adapted to be worn by the person such that the position of the person is determined by determining the position of the wrist worn device using the second GPS.

11. The trolling motor for an overboard person according to claim 10 wherein the wrist worn device comprises at least one biometric sensor;

wherein the at least one biometric sensor monitors one or more biometric parameters of the person which is communicated wirelessly to the controller;

wherein the controller is adapted to utilize the one or more biometric parameters to supplement the decision that the person have fallen overboard.

12. The trolling motor for an overboard person according to claim 11 wherein the at least one biometric sensor is a pulse sensor.

13. The trolling motor for an overboard person according to claim 11 wherein the second microcontroller is a computer processor that incorporates the functions of a central processing unit in the form of one or more integrated circuits;

wherein the second microcontroller is a multipurpose, clock driven, register based, digital-integrated circuit;

wherein the second microcontroller accepts binary data as input, processes the binary data according to instructions stored in memory contained within the second microcontroller, and provides results as output;

wherein the second microcontroller contains both combinational logic and sequential digital logic;

wherein the second microcontroller operates on numbers and symbols represented in the binary numeral system.

14. The trolling motor for an overboard person according to claim 13 wherein the second microcontroller electrically communicates with the first GPS to determine a position of the wrist worn device;

wherein the second microcontroller electrically communicates with the second wireless transceiver in order to wirelessly pass messages to and from the control unit;

wherein the messages comprises the position of the wrist worn device being communicated to the control unit.

15. The trolling motor for an overboard person according to claim 14 wherein in a non-emergency operating mode, the trolling motor is adapted to be under control of the person;

wherein the speed and forward/reverse direction that the trolling motor moves the water craft are determined by the one or more operator controls and the speed control and the water craft is steered using the tiller.

16. The trolling motor for an overboard person according to claim 15 wherein the control unit operates in an emergency operating mode when the control unit determines that the person has fallen overboard.

17. The trolling motor for an overboard person according to claim 16 wherein in the emergency operating mode, the speed and forward/reverse direction that the trolling motor moves the water craft are determined by the control unit;

wherein the control unit repeatedly energizes and deenergizes the electric motor in an effort to move the water craft closer to the person wearing the wrist worn device as determined by the separation distance calculated by the control unit.

18. The trolling motor for an overboard person according to claim 17 wherein the control unit moves the water craft forward and backward to reduce the separation distance.

19. The trolling motor for an overboard person according to claim 17 wherein a bias spring forces the trolling motor to one side or the other in the absence to an external steering force;

wherein with the steering biased by the bias spring, the water craft circles a specific area.

20. The trolling motor for an overboard person according to claim 17 wherein the wireless communication between the first wireless transceiver and the second wireless transceiver are operable over Bluetooth® protocols.

* * * * *